US009039148B2

(12) United States Patent
Murphy et al.

(10) Patent No.: US 9,039,148 B2
(45) Date of Patent: May 26, 2015

(54) INK SUPPLY RESERVOIR

(75) Inventors: Bryan Murphy, Leixlip (IE); Odhran Hendley, Leixlip (IE); Eduardo Macias, Leixlip (IE); Michael Mulloy, Leixlip (IE); Jon Rittgers, Leixlip (IE)

(73) Assignee: Hewlett-Packard Development Company, L.P., Houston, TX (US)

( * ) Notice: Subject to any disclaimer, the term of this patent is extended or adjusted under 35 U.S.C. 154(b) by 55 days.

(21) Appl. No.: 13/704,150

(22) PCT Filed: Jun. 15, 2010

(86) PCT No.: PCT/US2010/038682
§ 371 (c)(1),
(2), (4) Date: Dec. 13, 2012

(87) PCT Pub. No.: WO2011/159285
PCT Pub. Date: Dec. 22, 2011

(65) Prior Publication Data

US 2013/0083137 A1 Apr. 4, 2013

(51) Int. Cl.
*B41J 2/175* (2006.01)

(52) U.S. Cl.
CPC ..... *B41J 2/17556* (2013.01); *Y10T 29/49401* (2015.01); *B41J 2/17513* (2013.01); *B41J 2/17559* (2013.01)

(58) Field of Classification Search
CPC .... B41J 2/175; B41J 2/17513; B41J 2/17509; B41J 2/17596; B41J 2/17553
See application file for complete search history.

(56) References Cited

U.S. PATENT DOCUMENTS

| | | | | |
|---|---|---|---|---|
| 6,286,945 | B1 | 9/2001 | Higuma et al. | |
| 6,332,675 | B1 * | 12/2001 | Koitabashi et al. | 347/86 |
| 7,445,320 | B2 | 11/2008 | Jung et al. | |
| 7,520,927 | B2 * | 4/2009 | Yamakami et al. | 106/31.47 |
| 2002/0021341 | A1 * | 2/2002 | Higuma et al. | 347/86 |
| 2003/0043240 | A1 | 3/2003 | Dowell | |
| 2009/0167795 | A1 * | 7/2009 | Yokouchi | 347/6 |

FOREIGN PATENT DOCUMENTS

| | | |
|---|---|---|
| JP | 9018137 | 1/1997 |

* cited by examiner

*Primary Examiner* — Manish S Shah
*Assistant Examiner* — Jeremy Delozier
(74) *Attorney, Agent, or Firm* — Dicke, Billig & Czaja, PLLC

(57) ABSTRACT

An ink supply reservoir, and method of supplying ink, is described.

20 Claims, 5 Drawing Sheets

INK SUPPLY RESERVOIR

CROSS-REFERENCE TO RELATED APPLICATION

This Utility Patent Application is a U.S. National Stage filing under 35 U.S.C. §371 of PCT/US10/038,682, filed Jun. 15, 2010, published Dec. 22, 2011 as WO 2011/159285 incorporated by reference herein.

BACKGROUND

Printers have become commonplace in the home and workplace. Consequently, consumers have become familiar with replacing ink supplies or cartridges in printers while ink manufacturers have built high volume businesses of filling and shipping such cartridges. Despite the overwhelming success of these businesses, many challenges remain. For example, some ink supplies or cartridges may drool ink when transported to a significantly different altitude. In other contexts, pigment-based ink supplies or cartridges lose efficiency or effectiveness as precipitates form within the pigment-based ink, and then those precipitates partially clog a fluid interconnect to a printhead. Conventional attempts at overcoming such clogging include active mixing, avoiding pigment-based inks, or filtering. Each of these attempted solutions increases the cost and/or complexity of the ink supply or cartridge.

Moreover, a constant challenge remains to maximize the amount of ink within a supply or cartridge that is available for printing beyond the amount of ink that becomes effectively sacrificed to a capillary media used for creating negative pressures within the supply or cartridge.

Accordingly, designers of ink supplies still face many challenges in providing an ideal customer experience with replaceable ink supplies.

DETAILED DESCRIPTION

Figure 1:
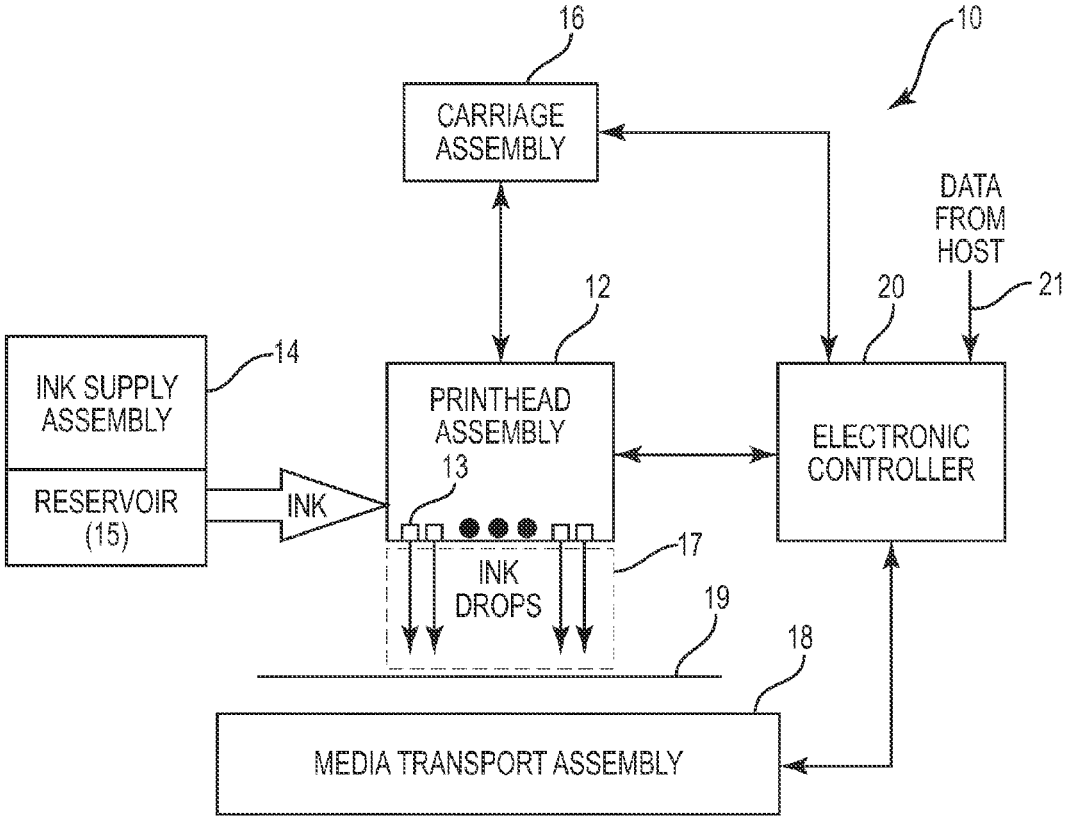
FIG. 1 is a block diagram of an ink supply assembly of a printing system, according to an embodiment of the present general inventive concept.

In the following detailed description, reference is made to the accompanying drawings which form a part hereof, and in which is shown by way of illustration specific embodiments in which the present general inventive concept may be practiced. In this regard, directional terminology, such as "top," "bottom," "front," "back," "leading," "trailing," etc., is used with reference to the orientation of the Figure(s) being described. Because components of embodiments of the present general inventive concept can be positioned in a number of different orientations, the directional terminology is used for purposes of illustration and is in no way limiting. It is to be understood that other embodiments may be utilized and structural or logical changes may be made without departing from the scope of the present general inventive concept. The following detailed description, therefore, is not to be taken in a limiting sense, and the scope of the present general inventive concept is defined by the appended claims.

Embodiments of the present general inventive concept are directed to preventing drooling of ink from an ink supply reservoir and/or minimizing deleterious effects of pigment precipitation within an ink supply reservoir. In one embodiment, multiple free ink chambers are located immediately below a negative pressure generating member such that ink traveling from each free ink chambers to a fluidic interconnect (to a printhead) first passes through the negative pressure generating member before reaching the fluidic interconnect. In this arrangement, ink moves from each free ink chamber vertically upward into the negative pressure member for migration to the fluidic interconnect while any pigment that flocculates or precipitates within the free ink settles to a bottom of the respective free ink chamber. Because the free ink moves from the chambers vertically upward against gravity into the negative pressure generating member, the pigment precipitates become captured via the force of gravity at the bottom of the respective free ink chambers. Accordingly, such settled precipitates will be unable to travel to the fluidic interconnect and also will not be able to clog pathways through the negative pressure generating member.

In another embodiment, an ink supply reservoir comprises a series of free ink chambers, including a first chamber having a fluidic interconnect configured to communicate with a printhead. A negative pressure generating member resides in a second chamber at an opposite end of the container near a vent. With the negative pressure generating member located immediately adjacent the vent with the container sealed tightly at the fluidic interconnect during transport, drool is prevented while maximizing the volume of free ink that can be held by the ink supply container.

In this way, embodiments of the present general inventive concept of an ink supply container of a printing system maximize a volume of free ink held within the ink supply container, minimize drooling during transport, and/or minimize effects of pigment precipitates on a negative pressure generating member or the fluidic interconnect.

These embodiments, and additional embodiments, are described and illustrated in association with FIGS. 1-9.

FIG. 1 illustrates an inkjet printing system 10 in accordance with one embodiment of the present general inventive concept. Inkjet printing system 10 includes an inkjet printhead assembly 12, an ink supply assembly 14, a carriage assembly 16, a media transport assembly 18, and an electronic controller 20. Inkjet printhead assembly 12 includes one or more printheads which eject drops of ink through orifices or nozzles 13 and toward a print media 19 so as to print onto print media 19. Print media 19 is any type of suitable sheet material, such as paper, card stock, envelopes, labels, transparencies, Mylar, and the like. Typically, nozzles 13 are arranged in one or more columns or arrays such that properly sequenced ejection of ink from nozzles 13 causes characters, symbols, and/or other graphics or images to be printed upon print media 19 as inkjet printhead assembly 12 and print media 19 are moved relative to each other.

Ink supply assembly 14 supplies ink to printhead assembly 12 and includes a reservoir 15 for storing ink. As such, ink flows from reservoir 15 to inkjet printhead assembly 12. In one embodiment, inkjet printhead assembly 12 and ink supply assembly 14 are housed together in an inkjet cartridge or pen. In some embodiments, ink supply assembly 14 is separate from inkjet printhead assembly 12 but still directly communicates ink to the printhead assembly 12 via a releasable connection with the ink supply assembly 14 being mounted directly above and at least partially supported by the printhead assembly 12. This embodiment is sometimes referred to as an on-axis configuration of the ink supply assembly 14. However, in other embodiments, the ink supply assembly 14 is positioned remotely from the printhead assembly 12, with the ink supply assembly 14 communicating ink to the printhead assembly 12 via an array of supply tubes. This embodiment is sometimes referred to as an off-axis configuration of the ink supply assembly 14.

Carriage assembly 16 positions inkjet printhead assembly 12 relative to media transport assembly 18 and media transport assembly 18 positions print media 19 relative to inkjet printhead assembly 12. Thus, a print zone 17 is defined adjacent to nozzles 13 in an area between inkjet printhead assembly 12 and print media 19. In one embodiment, inkjet printhead assembly 12 is a non-scanning type printhead assembly. As such, carriage assembly 16 fixes inkjet printhead assembly 12 at a prescribed position relative to media transport assembly 18. Thus, media transport assembly 18 advances or positions print media 19 relative to inkjet printhead assembly 12.

Electronic controller 20 communicates with inkjet printhead assembly 12, media transport assembly 18, and, in one embodiment, carriage assembly 16. Electronic controller 20 receives data 21 from a host system, such as a computer, and includes memory for temporarily storing data 21. Typically, data 21 is sent to inkjet printing system 10 along an electronic, infrared, optical or other information transfer path. Data 21 represents, for example, an image, a document, and/or file to be printed. As such, data 21 forms a print job for inkjet printing system 10 and includes one or more print job commands and/or command parameters.

In one embodiment, electronic controller 20 provides control of inkjet printhead assembly 12 including timing control for ejection of ink drops from nozzles 13. As such, electronic controller 20 operates on data 21 to define a pattern of ejected ink drops which form characters, symbols, and/or other graphics or images on print media 19. Timing control and, therefore, the pattern of ejected ink drops, is determined by the print job commands and/or command parameters. In one embodiment, logic and drive circuitry forming a portion of electronic controller 20 is located on inkjet printhead assembly 12. In another embodiment, logic and drive circuitry is located remotely from inkjet printhead assembly 12.

Figure 2:
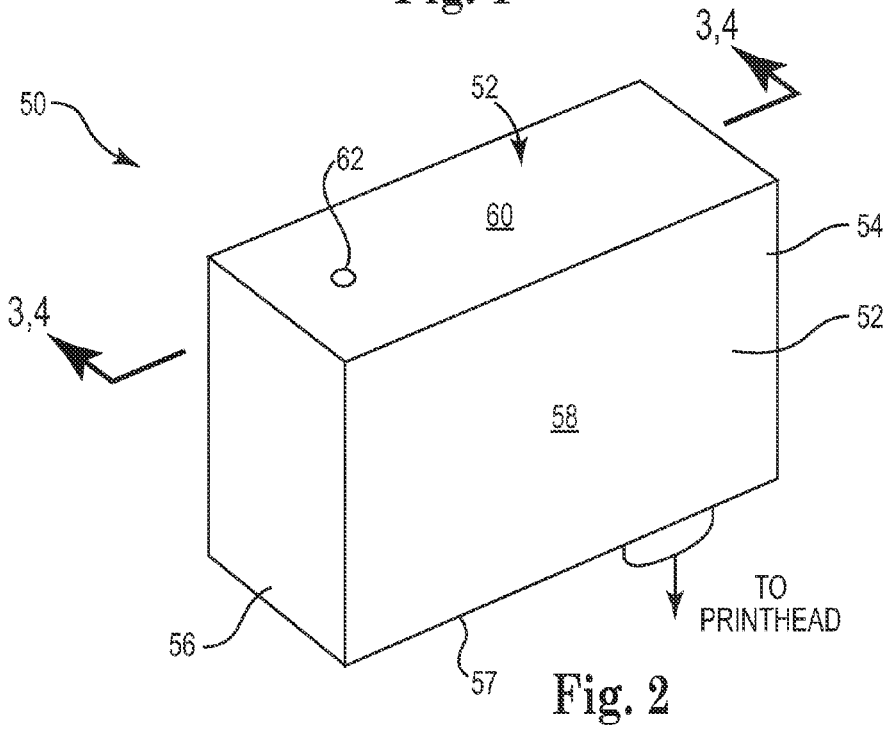
FIG. 2 is perspective view schematically illustrating an ink supply reservoir, according to an embodiment of the present general inventive concept.

FIG. 2 is a perspective sectional view schematically illustrating an ink supply reservoir 50, according to an embodiment of the present general inventive concept. In one embodiment, ink supply reservoir 50 comprises at least substantially the same features and attributes of ink supply reservoir 15 that was previously described in association with FIG. 1. As shown in FIG. 2, ink supply reservoir 50 includes container 52 having a first end 54, a second end 56, bottom 57, sidewalls 58, and top 60 with vent 62.

Figure 3:
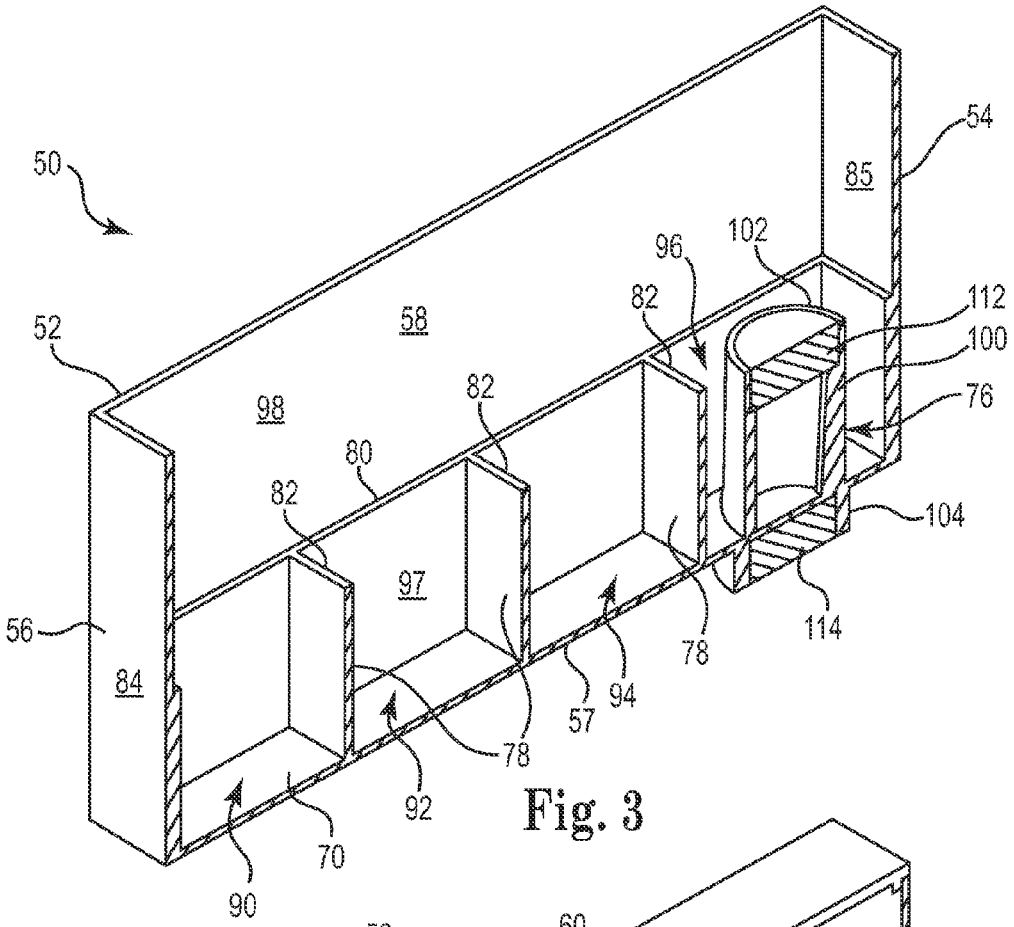
FIG. 3 is a sectional view, as taken along lines 3-3 of FIG. 2, schematically illustrating an ink supply reservoir, according to an embodiment of the present general inventive concept.

FIG. 3 is a sectional view of the ink supply reservoir 50 of FIG. 2, according to an embodiment of the present general inventive concept. As shown in FIG. 3, container 52 includes a floor 70 from which several partitions 78 extend vertically upward, with the partitions 78 spaced apart along a length of container from first end 54 to second end 56. A top 82 of each respective partition 78 terminates adjacent a ledge 80 formed in sidewall 58 and endwalls 84, 85. With this arrangement, the floor 70, partitions 82, side wall 58, and end walls 84, 85 define a series of chambers 90, 92, 94, 96 in a lower portion 97 of container 52.

As further shown in FIG. 3, a first chamber 96 includes a fluid communication port or interconnect 76, which includes a generally tubular shaft 100 defining a first end 102 and second end 104. The first end 102 houses a first wick element 112 and the second end 104 houses a second wick element 114. In one aspect, the second end 104 protrudes downwardly from bottom 57 and is configured to releasably engage a portion of a printhead assembly to supply ink from ink supply reservoir 50 to a printhead. In one embodiment, shaft 100 has a height configured so that first end 102 is generally at the same height as top 82 of partitions 78 and ledge 80.

Figure 4:
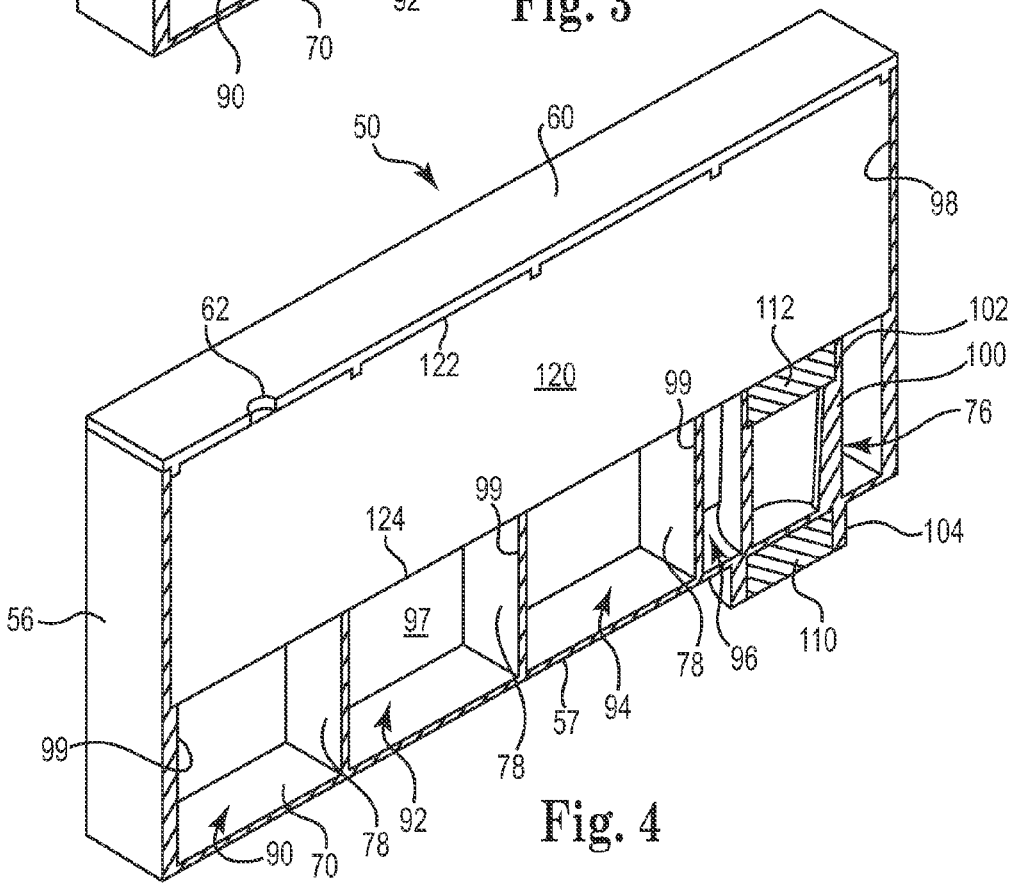
FIG. 4 is a sectional view, as taken along lines 4-4 of FIG. 2, schematically illustrating an ink supply reservoir, according to an embodiment of the present general inventive concept.

As further shown in FIG. 4, ink supply reservoir 50 further includes negative pressure generating member 120, which is contained within an upper portion 98 of container 52. In one aspect, upper portion 98 includes that portion of container extending vertically above the ledge 80 and above the top of partitions 82, such that upper portion defines the volume within container 52 above chambers 90, 92, 94, 96. In one embodiment, negative pressure generating member 120 comprises a block of capillary media or foam, familiar to those skilled in the art for use in ink supply containers. In one embodiment, negative pressure generating member 120 comprises a hydrophilic material configured to attract and uptake ink or other liquids.

The negative pressure generating member 120 is generally sized and shaped (e.g., such as a rectangular shape) to occupy substantially the entire volume of upper portion 98 above chambers 90, 92, 94, 96. In one aspect, the respective chambers 90, 92, 94, 96 extend generally parallel to each other in the same orientation, which is generally perpendicular to a longitudinal axis of the negative pressure generating member 120. With this arrangement, an upper surface 122 of member 120 is in close contact with and/or fluid communication with vent 62, and a lower surface 124 of member 130 is in direct fluid communication with the first end 102 of fluid interconnect 76. At the same time, the negative pressure generating member 120 directly interfaces with the open end 99 of each respective chamber 90, 92, 94, and 96. In this way, the negative pressure generating member 120 completely occupies the space to form the path between vent 62 and fluidic interconnect 76 and between the chambers 90, 92, 94, 96 to fluidic interconnect 76.

It will be understood that in another embodiment, instead of using wick elements within the tubular shaft 100, a second elongate negative pressure generating member is provided to extend from negative pressure generating member 120 to the open end 104 of fluidic interconnect 76

In one embodiment, vent 62 comprises a labyrinth-type vent familiar to those skilled in the art, and is located adjacent second end 56 of container 52 while fluidic interconnect 76 in first chamber 96 is adjacent first end 54 of container 52, such that vent 62 and fluidic interconnect 76 are located at generally opposite ends of container 52.

Figure 5:
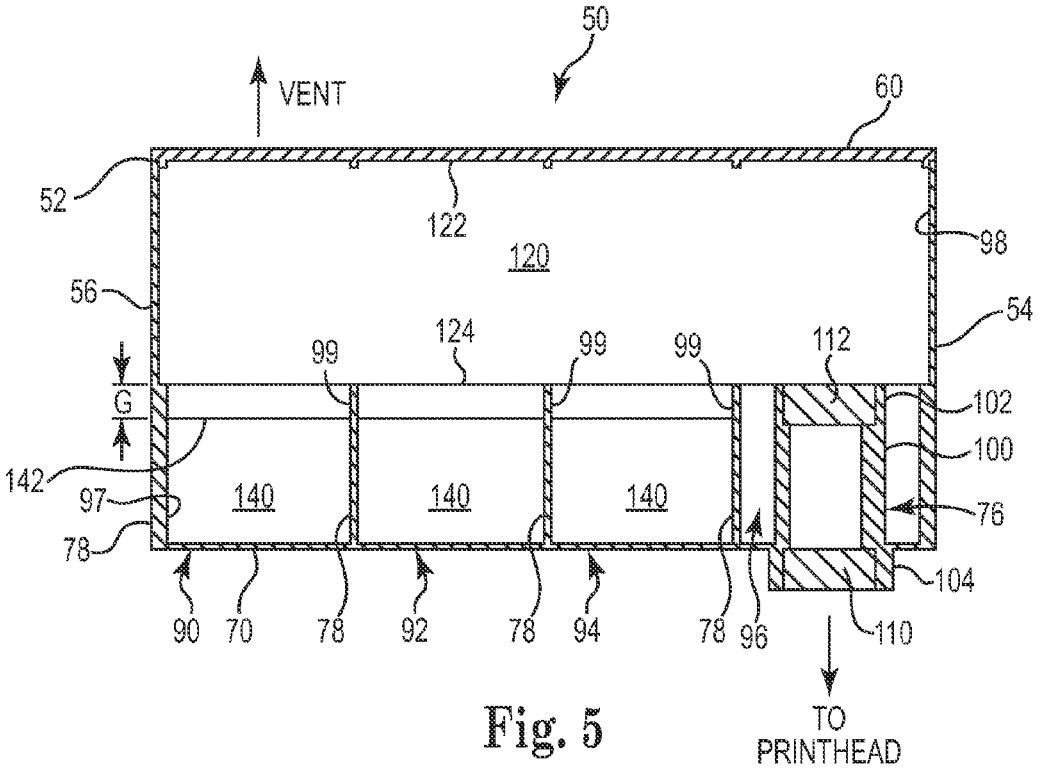
FIG. 5 is a sectional view schematically illustrating an ink supply reservoir, according to an embodiment of the present general inventive concept.

With this arrangement in mind, FIG. 5 is a side sectional view further illustrating the interior of container 52 with ink 140 present in the container 52. In an initial state, negative pressure generating member 120 is filled with ink to a desired level that is sufficient to reach an equilibrium state with the free ink chambers 90, 92, 94 such that free ink chambers 90, 92, 94 become effectively sealed so that in this initial state, no ink transfers from the free ink chambers 90, 92, 94 to the negative pressure generating member 120 but negative pressure generating member 120 is still capable of exerting back pressure on the respective free ink chambers 90, 92, 94. It will be understood that in this initial state each free ink chamber 90, 92, 94 is completely filled with ink 140.

However, during use, as ink from the negative pressure generating member 120 is consumed and thereby partially drained, air paths are formed in the negative pressure generating member 120. These air paths allow air to displace ink as free ink is drawn up from the free ink chambers 90, 92, 94 into the negative pressure generating member 120. As the newly transferred free ink fills the negative pressure generating member 120, the negative pressure generating member 120 refills, thereby closing air paths (within the negative pressure generating member) which results in controlling or regulating (e.g. slowing or temporarily stopping) ink transfer from the free ink chambers 90, 92, 94.

In use, as the level of ink 140 within each free ink chamber 90, 92, 94 falls over time, a gap G is created between the top surface 142 of the free ink 140 and the bottom surface 124 of the negative pressure generating member 120. In this situation, in order to transfer ink 140 out of the free ink chambers, ink 140 has to overcome this gap G before being taken up into negative pressure generating member 120. This transfer occurs in at least one of two ways. In a first way, as carriage assembly 16 (FIG. 1) causes ink supply reservoir 50 (15 in FIG. 1) to move back and forth across the media (to be printed on), this movement causes a portion of ink 140 to splash or be jostled, which causes a portion of ink 140 to contact lower surface 124 of negative pressure generating member 120. Upon such contact, ink 140 is taken up by the capillary force of the negative pressure generating member 120 resulting in the transfer of ink 140 out of the respective free ink chambers 90, 92, 94.

In a second way, in addition to having a predetermined spacing apart from each other, partitions 78 are sized, shaped, made of a suitable material to induce or permit travel of ink 140 by capillary forces into negative pressure generating member 120.

It also will be understood that the lower portion 97 of container 52 is not limited strictly to three free ink chambers or a total of four chambers, but that container 52 includes greater or fewer than the chambers 90, 92, 94, 96 illustrated in FIGS. 3-5.

By placing the free ink chambers 90, 92, 94 below the negative pressure generating member 120, pigment within ink 140 is allowed to settle in a bottom portion of the respective free ink chambers 90, 92, 94 by action of gravity on the pigment particulates in ink 140. Accordingly, by trapping precipitates or flocculants in chambers 90, 92, 94, this arrangement prevents pigment precipitates from entering and plugging portions of negative pressure generating member 120 or of fluidic interconnect 76. Consequently, ink supply reservoir 50 eliminates or minimizes the conventional use of settling inhibitors, active mixing systems, and/or additional filtering mechanisms—any of which would otherwise increase the cost or complexity of the ink supply reservoir 50.

Figure 6:
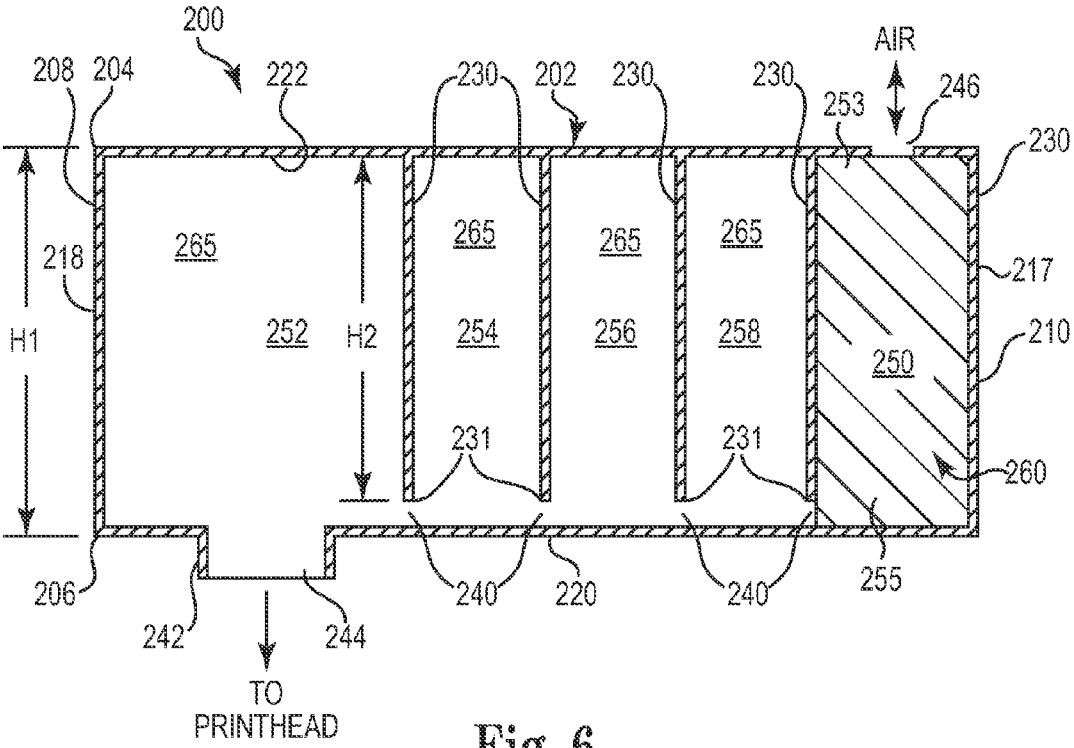
FIG. 6 is a sectional view schematically illustrating another ink supply reservoir, according to an embodiment of the present general inventive concept.

FIG. 6 is a sectional view of an ink supply reservoir 200, according to another embodiment of the present general inventive concept. In one embodiment, ink supply reservoir 200 comprises at least substantially the same features and attributes of ink supply reservoir 15 that was previously described in association with FIG. 1. As shown in FIG. 6, ink supply reservoir 200 includes container 202 having a first end 208, a second end 210, top 204 with vent 246, and bottom 206.

As shown in FIG. 6, container 202 includes a ceiling 222 from which several partitions 230 extend vertically downward, with the partitions 230 spaced apart along a length of container from first end 208 to second end 210. A bottom 231 of each respective partition 230 terminates adjacent floor 220 of container 202. With this arrangement, the ceiling 222, partitions 230, side wall (shown as elements 58 in FIG. 1), and end walls 217, 218 define a series of chambers 252, 254, 256, 258, 260. Moreover, the small gap 240 between the bottom 231 of the respective partitions 230 and the floor 220 form bubbler mechanisms between the adjacent chambers 252, 254, 256, 258, 260, which allow air and ink to pass from one chamber to another chamber.

As further shown in FIG. 6, the first chamber 252 includes a fluid communication port or interconnect 242, which houses a wick element 244 and which protrudes downwardly from bottom 220 of container 202. The fluid interconnect 242 is configured to releasably engage a portion of a printhead assembly to supply ink from ink supply reservoir 200 to a printhead. As shown in FIG. 6, first chamber 252 is one of a series of free ink chambers and is located at first end 208 of container 202.

As further shown in FIG. 6, ink supply reservoir 200 further includes negative pressure generating member 250, which is contained within chamber 260 of container 200 at second end 210, to be at a generally opposite end from first chamber 252 at which fluidic interconnect 242 is located. In one embodiment, negative pressure generating member 250 comprises a block of capillary media or foam, familiar to those skilled in the art for use in ink supply containers. In one embodiment, negative pressure generating member 250 comprises a hydrophilic material configured to attract and uptake ink or other liquids.

The negative pressure generating member 250 is generally sized and shaped (e.g., such as a rectangular shape) to occupy substantially the entire volume within chamber 260. With this arrangement, an upper portion 253 of member 250 is in close contact with and/or fluid communication with vent 246, and a lower portion 255 of member 250 is in direct fluid communication with chamber 258 via gap or bubbler mechanism 240. In this way, the negative pressure generating member 250 is interposed vent 246 and fluidic interconnect 242 and interposed between vent 246 and the free ink chambers 252, 254, 256, 258.

In one embodiment, vent 246 comprises a labyrinth-type vent familiar to those skilled in the art, and is located adjacent second end 210 of container 202 while fluidic interconnect 242 at the bottom of first chamber 252 is adjacent first end 208 of container 202, such that vent 246 and fluidic interconnect 242 are located at generally opposite ends of container 202.

It will be understood that the container 202 is not limited strictly to four free ink chambers 252, 254, 256, 258 or a total of five chambers, but that in other embodiments, container 202 includes greater or fewer than the free ink chambers 252, 254, 256, 258 that are illustrated in FIG. 6.

With this arrangement in mind, it will be understood that in an initial state, the negative pressure generating member 250 is sufficiently wetted in the vent region to seal the vent path to the free ink chambers 252, 254, 256, and 258 while ink 265 completely fills the respective chambers 252, 254, 256, and 258.

Figure 7:
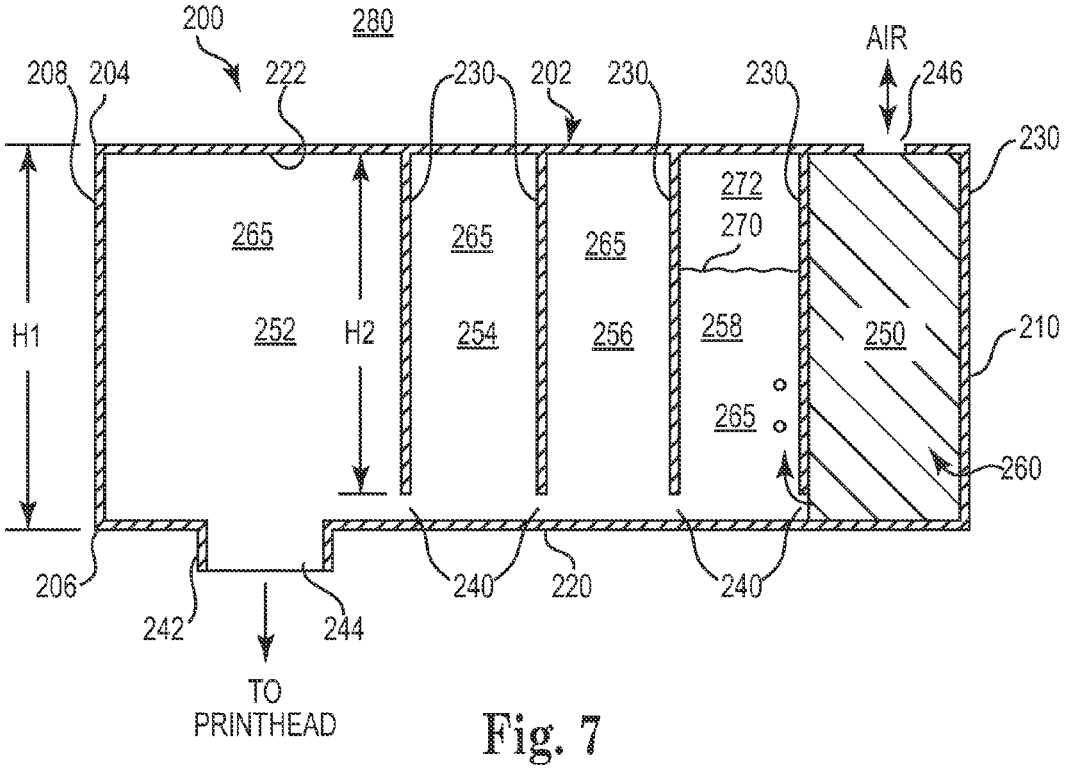
FIG. 7 is a sectional view schematically illustrating the ink supply reservoir of FIG. 6 after consumption of some ink, according to an embodiment of the present general inventive concept.

In use, with bubbler mechanisms 240 allowing air to transfer from chamber to chamber as ink 265 is consumed via fluidic interconnect 242, the ink is depleted from one free ink chamber at a time beginning with the free ink chamber 258 that is furthest from the fluidic interconnect 242 (or closest to the negative pressure generating member 250 in chamber 260), as further illustrated in FIG. 7. In particular, as shown in FIG. 7, ink 265 is first consumed from chamber 258 with air 272 present above a top surface 270 of ink 265 in chamber 258 with air entering via bubbler 240 as shown. As more ink is consumed, top surface 270 drops even further.

Figure 8:
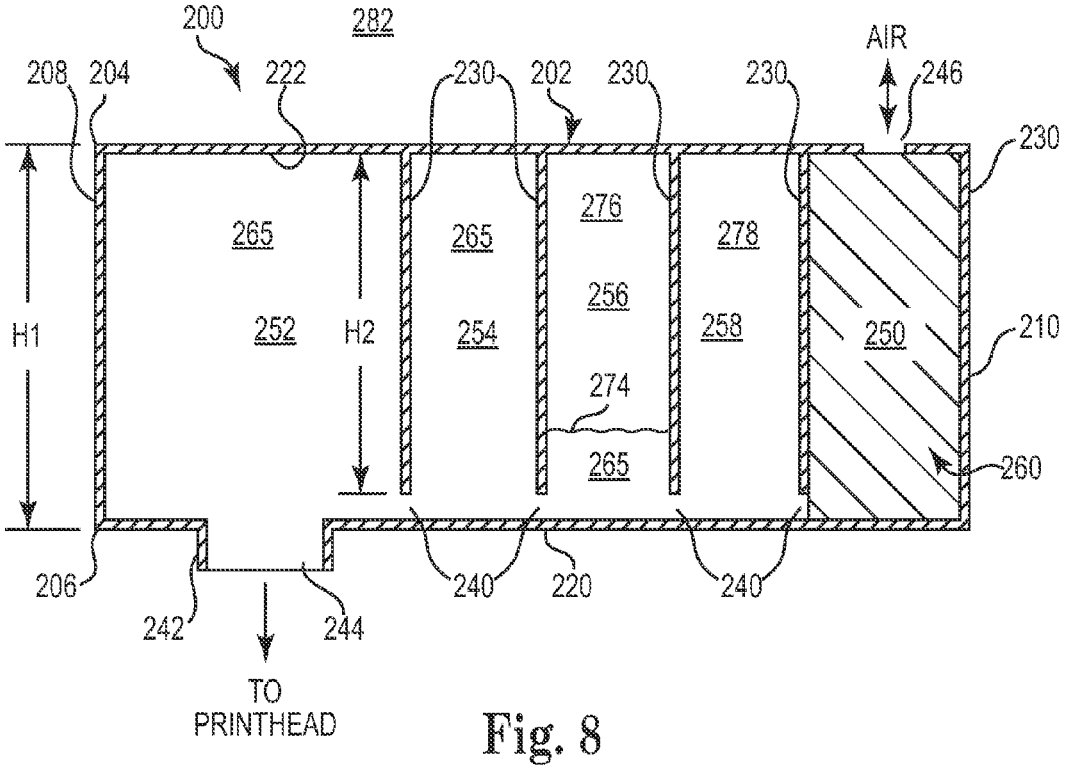
FIG. 8 is a sectional view schematically illustrating the ink supply reservoir of FIG. 7 after further consumption of ink, according to an embodiment of the present general inventive concept.

In addition, the ink is consumed from the free ink chambers 252, 254, 256, 258 before being consumed from the negative pressure generating member 250. Accordingly, venting will start at chamber 258 and work forward (toward end 208) chamber-by-chamber until chamber 252 is emptied last. With this arrangement, just one of the respective chambers will have both air and ink at a given time, as shown in FIG. 7. As further illustrated in FIG. 8, as the ink is completely depleted from free ink chamber 258, ink is then depleted from the next chamber 256 such that chamber 256 now exhibits the partial ink and partial air relationship while chamber 258 remains empty. As shown in FIG. 8, air 276 resides above top surface 274 of ink 265 in chamber 256 and air 278 resides in chamber 258.

Accordingly, by arranging container 202 to include many smaller chambers instead of a single larger free ink chamber, and causing the chambers to empty one-by-one, the relative amount of air available to influence altitude-related drooling is reduced as compared to conventional arrangements.

In a related aspect, negative pressure generating member 250 is sized to accommodate ink from a partial ink and air chamber. For instance, as the air expands because the ink supply reservoir 200 is at a higher altitude, ink would be pushed from the partial ink/air chamber into the negative pressure generating member. With the negative pressure generating member 250 being appropriately sized relative to the size of free ink chambers 252, 254, 256, 258, the negative pressure generating member 250 would have sufficient capacity to absorb the ink displaced from expansion of air in container 202 should the printer and/or individual supplies be transported to higher altitudes.

Moreover, by reducing the overall volume of the negative pressure generating member (as compared to conventional arrangement of the negative pressure generating member directly over the fluidic interconnect), the container 202 holds a greater volume of free ink without increasing the external dimensions of the container 202.

Finally, because the ink is consumed from the free ink chambers 252, 254, 256, 258, and with a free ink chamber 252 directly over the fluidic interconnect 242, a determination of an end-of-life for the ink supply reservoir 200 is more definite as compared a conventional arrangement when a negative pressure generating member is directly over the fluidic interconnect to the printhead.

Figure 9:
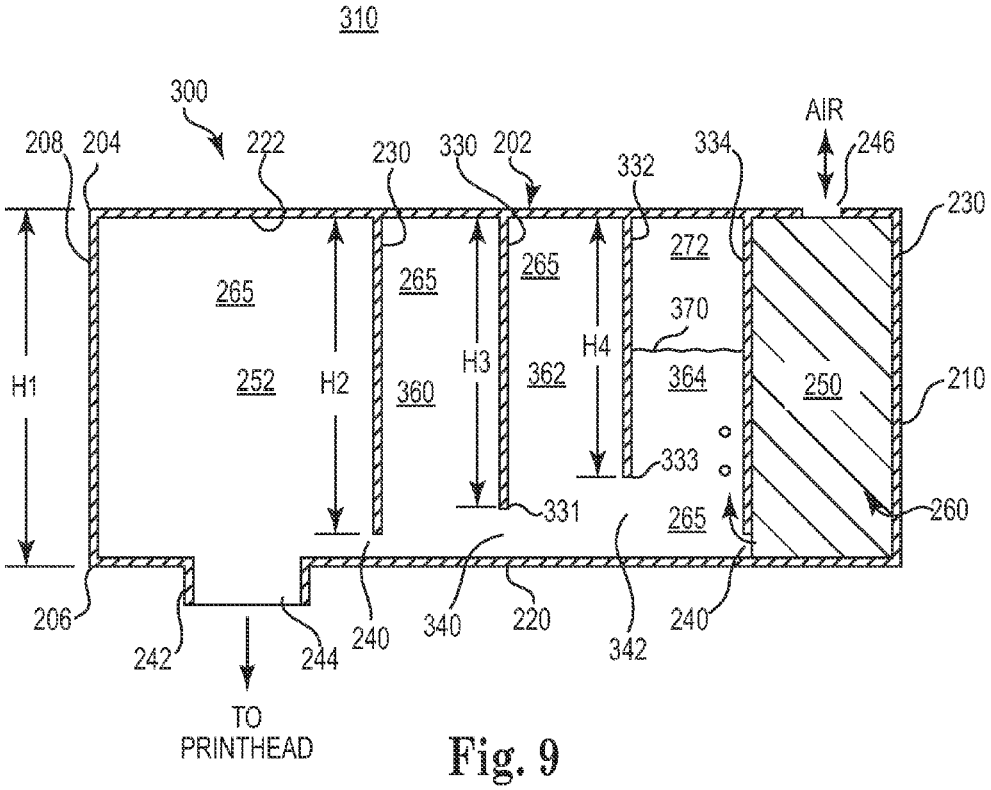
FIG. 9 is a sectional view schematically illustrating an ink supply reservoir, according to an embodiment of the present general inventive concept.

FIG. 9 schematically illustrates another ink supply reservoir 300, according to an embodiment of the present general inventive concept. In one embodiment, reservoir 300 comprises substantially the same features and attributes as reservoir 200 (as previously described in association with FIGS. 6-8) except for the partitions 230, 330, and 332 having varying lengths arranged in a staggered relationship. In particular, as illustrated in FIG. 9, partition 330 has a height (H3) that is shorter than the height (H2) of partition 230, and where partition 332 has a height (H4) that is shorter than the height (H3) of partition 330. In one aspect, partition 334 has a height substantially the same as the height (H2) of partition 230. With this arrangement, the relatively shorter wall 332 better facilitates emptying of chamber 364 prior to emptying of the other free ink chambers 252, 360, 362. As illustrated in FIG. 9, chamber 364 is shown with partial depletion of ink 265 in chamber 364 such that air 372 resides over top surface 370 of ink 265.

Embodiments of the present general inventive concept enable clean transport of ink supplies without drooling at altitude and/or prevent clogging of a fluidic interconnect due to precipitation of pigments within the ink supply.

Although specific embodiments have been illustrated and described herein, it will be appreciated by those of ordinary skill in the art that a variety of alternate and/or equivalent implementations may be substituted for the specific embodiments shown and described without departing from the scope of the present invention. This application is intended to cover any adaptations or variations of the specific embodiments discussed herein. Therefore, it is intended that this invention be limited only by the claims and the equivalents thereof.

The invention claimed is:

1. An ink supply reservoir comprising:

an upper portion including a top cover having a vent;

a lower portion defining a series of chambers, including:

a first chamber positioned at a first end of the lower portion and including an external fluid communication port; and at least one second chamber positioned adjacent the first chamber and configured to hold a free volume of ink;

wherein all of the respective chambers are in fluid communication with the upper portion; and a negative pressure generating member contained within the upper portion, extending across a top of each respective chamber and external to each respective chamber, wherein the negative pressure generating member is direct communication with the fluid communication port and with the vent.

2. The ink supply reservoir of claim 1, wherein the negative pressure generating member is made of a hydrophilic material and wherein the at least one second chamber is configured to cause transfer of ink vertically upward into the negative pressure generating member.

3. The ink supply reservoir of claim 1, wherein the fluid communication port of the first chamber comprises a conduit having a height generally equal to a height of the at least one second chambers and that is in communication with the lower surface of the negative pressure generating member.

4. The ink supply reservoir of claim 1, wherein the reservoir includes a floor generally opposite the top cover, wherein each chamber of the lower portion is defined by a pair of walls extending vertically upward from the floor of the reservoir, and wherein the chambers extend generally parallel to each other in a first orientation that is generally perpendicular to a longitudinal axis of the negative pressure generating member.

5. The ink supply reservoir of claim 4, wherein the respective other chambers are configured relative to the negative pressure generating member to cause transfer of free ink from the respective other chambers into a lower surface of the negative pressure generating member based on at least one of:

movement of the reservoir during a printing operation; or capillary action via the walls of the reservoir defining the respective other chamber.

6. The ink supply reservoir of claim 1, wherein the negative pressure generating member is in direct contact with the top of each respective chamber.

7. The ink supply reservoir of claim 1, wherein:

the free volume of ink is expelled from the fluid communication port in a first direction; and all of the respective chambers are in fluid communication with the negative pressure generating member in the upper portion in a second direction substantially opposite to the first direction.

8. The ink supply reservoir of claim 1, wherein the first chamber is not in direct fluid communication with the at least one second chamber.

9. The ink supply reservoir of claim 1, wherein the lower portion includes a bottom cover, the bottom cover being opposite the top cover, extending in a direction substantially parallel to an extension direction of the top cover, and including the external fluid communication port.

10. The ink supply reservoir of claim 9, wherein a plane including the top cover in its entirety is substantially perpendicular to a plane including a sidewall of the first chamber in its entirety.

11. An ink supply reservoir comprising:

a container having a first end and a second end, and at least three chambers including:

a first chamber at the first end and including a floor defining a fluid communication port, the first chamber configured to hold a free volume of ink;

a second chamber at the second end and including a ceiling defining a vent, the second chamber containing a negative pressure generating member that occupies substantially the entire volume of the second chamber; and one or more third chambers interposed between the respective first and second chambers, with each respective third chamber configured to hold a free volume of ink, wherein each respective chamber is in communication with, via a bubbler mechanism, an adjacent one of the other respective chambers at a bottom portion of the respective chambers.

12. The ink supply reservoir of claim 11, wherein the negative pressure generating member extends from a floor to a ceiling of the container.

13. The ink supply reservoir of claim 12, wherein each chamber is defined by a pair of walls extending vertically downward from the ceiling of the container, and wherein the first and third chambers extend generally parallel to each other and are sized to cause depletion of free ink from the chambers one chamber at-a-time.

14. The ink supply reservoir of claim 13, wherein the third chambers are arranged relative to the negative pressure generating member to cause the third chamber closest to the negative pressure generating member within the second chamber to become depleted of ink before the other third chambers and before the first chamber.

15. The ink supply reservoir of claim 13, wherein a height of the walls varies from a first end to a second end of the container.

16. The ink supply reservoir of claim 11, wherein the negative pressure generating member includes a capillary media, and the first chamber and the respective second chambers are devoid of the negative pressure generating member.

17. A container including:

at least three chambers arranged between a first end and a second end of a container, with a first respective chamber at the first end including a fluid communication port, at least the other respective chambers configured to hold a volume of free ink, wherein the at least three chambers include an open end facing in generally the same orientation;

a vent at a top portion of the second end of the container, the second end being generally opposite the first end; and a negative pressure generating member interposed between the vent and the other respective chambers to provide an ink supply path from the other respective chambers to the fluid communication port, wherein the negative pressure generating member is external to the at least three chambers.

18. The container of claim 17, wherein:

each of the other respective chambers include:

a top; and a closed bottom at a floor of the container and chamber walls having generally a same height from chamber to chamber;

the negative pressure generating member extends across the top of each of the other respective chambers;

the negative pressure generating member is configured to be in direct fluid communication with both the other respective chambers and the fluid communication port; and the other respective chambers are configured to transfer the volume of free ink vertically upward and into the negative pressure generating member.

19. The container of claim 18, wherein the other respective chambers are configured to transfer the volume of free ink vertically upward and into the negative pressure generating member based on at least one of:

movement of the container during a printing operation; and capillary action via the chamber walls.

20. The container of claim 17, wherein each of the other respective chambers include:

a closed top at a ceiling of the container and an open bottom adjacent a floor of the container; and walls having a length that extends substantially the entire height of the container.

* * * * *